US005629755A

United States Patent [19]

Ohtsuka

[11] Patent Number: 5,629,755

[45] Date of Patent: May 13, 1997

[54] IMAGE FORMING APPARATUS

[75] Inventor: Hirohisa Ohtsuka, Kawaguchi, Japan

[73] Assignee: Ricoh Company, Ltd., Tokyo, Japan

[21] Appl. No.: 522,101

[22] Filed: Aug. 31, 1995

[30] Foreign Application Priority Data

Sep. 1, 1994 [JP] Japan ..... 6-208959

[51] Int. Cl.[6] ..... G03G 15/02

[52] U.S. Cl. ..... 399/176; 399/100

[58] Field of Search ..... 355/219; 361/225, 361/230

[56] References Cited

U.S. PATENT DOCUMENTS

| | | | |
|---|---|---|---|
| 4,339,195 | 7/1982 | Gabelman | 355/219 |
| 5,499,078 | 3/1996 | Kurokawa et al. | 355/219 X |
| 5,532,795 | 7/1996 | Tatsumi et al. | 355/219 X |

FOREIGN PATENT DOCUMENTS

| | | |
|---|---|---|
| 0272582 | 11/1990 | Japan . |
| 0048870 | 3/1991 | Japan . |
| 0130787 | 6/1991 | Japan . |
| 5-188738 | 7/1993 | Japan . |
| 0265307 | 10/1993 | Japan . |
| 0341629 | 12/1993 | Japan . |
| 0003930 | 1/1994 | Japan . |
| 0083166 | 3/1994 | Japan . |
| 0121003 | 5/1995 | Japan . |
| 0140763 | 6/1995 | Japan . |
| 0199602 | 8/1995 | Japan . |
| 0199603 | 8/1995 | Japan . |
| 0281510 | 10/1995 | Japan . |

*Primary Examiner*—Matthew S. Smith
*Attorney, Agent, or Firm*—Oblon, Spivak, McClelland, Maier & Neustadt, P.C.

[57] ABSTRACT

An image forming apparatus includes a rotating photosensitive body, a charging member which is rotated in a direction opposite to a rotational direction of the photosensitive body while contacting the photosensitive body in order to uniformly charge a surface of the photosensitive body, a cleaning member for cleaning a surface of the charging member, and a device for bringing the charging member into contact with the photosensitive body or separating the charging member from the photosensitive body. The charging member is rotated contacting the cleaning member in order to clean the charging member when the charging member is separated from the photosensitive body. A surface peripheral speed of the charging member made when the charging member is separated from the photosensitive body is reduced to become slower than a surface peripheral speed of the charging member maintained when the charging member is rotated contacting the photosensitive body.

32 Claims, 11 Drawing Sheets

IMAGE FORMING APPARATUS

BACKGROUND OF THE INVENTION

1. Field of the Invention

This invention relates to an electrophotographic type of image forming apparatus which uses a contact-and-charge method of bringing a charging member into contact with a rotating photosensitive body in order to charge the photosensitive body.

2. Description of the Prior Art

An electrophotographic type of image forming apparatus, such as an electrostatic copying machine, a photoprinter, a facsimile, or the like, includes a unit for charging a photosensitive body to be charged and a unit for transferring a toner image formed on the surface of the photosensitive body to paper in a transferring process. In this type of image forming apparatus, conventionally, a noncontact-and-charge method, i.e., corona discharge method has been widely used. According to the corona discharge method, a high voltage is applied to tungsten wires called corona wires so as to carry out a discharge. For this reason, air is ionized and, as a result, large quantities of ozone and nitrogen oxide are generated. These are injurious to persons and exert a harmful influence on the environment. The ozone and nitrogen oxide adhere to the photosensitive body, charging member, optical systems, etc. of the image forming apparatus, thereby causing the deterioration of images.

Especially in the case of a minus discharge, ozone is conspicuously generated. In recent years, the generation of ozone has assumed a serious phase because an organic photosensitive body for the minus discharge has been widely used as a photosensitive body and because an environmental standard for generated gas has become rigid.

Accordingly, as a charging unit for resolving the above disadvantages, a contact-and-charge type of charging unit is being watched with keen interest. In the contact-and-charge type of charging unit, e photosensitive body is charged by contact with a charging roller as a charging member to which a voltage is applied.

An example of such a contact-and-charge type of charging unit is known as disclosed in, for example, Japanese Patent Application Early Laid-Open Publication Hei 3-48870. In the charging unit disclosed therein, a charging roller as a charging member is designed to be brought into and out of contact with a photosensitive body as an image carrier by means of a solenoid. The charging roller is brought into contact with the photosensitive body when the photosensitive body is charged by the charging roller whereas the charging roller is kept away from the photosensitive body when the photosensitive body is not charged by the charging roller. In this connection, there is also known a charging unit in which, when a photosensitive body is not charged by a charging roller, the charging roller is brought into contact with the photosensitive body by pressure smaller than that required when the photosensitive body is charged by the charging roller.

As shown in FIG. 18, a charging unit is also known in which a charging roller 62 is always pressed against a photosensitive body 60 by means of a spring 61 so that the charging roller 62 is brought into contact with the photosensitive body 60 and is rotated following the rotation of the photosensitive body 60, and a cleaning member 63 is arranged to be brought into and out of contact with the charging roller 62 by operating a solenoid 65 with predetermined timing.

Further, as disclosed in Japanese Patent Application Early Laid-Open Publication Hei 3-130787, a charging unit is known in which a charging roller supported by a lever so as to come in contact with a photosensitive drum or separate therefrom is kept away from the photosensitive drum and, at the same time, a cleaning member, such as a cleaning roller, a cleaning pad, or the like, is brought into contact with the charging roller when the photosensitive drum is not charged and before a power switch (copy key switch) is turned on. When the power switch is turned on, the charging roller is rotated keeping in contact with the cleaning member, so that the surface of the charging roller is cleaned. In addition, this publication (Hei 3-130787) discloses that it is desirable that the charging roller is rotated away from the photosensitive drum in order to clean the whole surface of the charging roller.

Further, as disclosed in Japanese Patent Application Early Laid-Open Publication Hei 3-188738, a charging unit is known in which a charging roller supported by a lever so as to come in contact with a photosensitive drum or separate therefrom is kept away from the photosensitive drum when the photosensitive drum is not charged whereas the charging roller is brought into contact with the photosensitive drum when the photosensitive drum is charged, and the driving force of the photosensitive drum is transmitted to the charging roller via a belt when the charging roller is separated from the photosensitive drum.

Referring again to the charging unit shown in FIG. 18, the circumferential speed (surface peripheral speed) of the surface of the charging roller 62 is constant whether the cleaning member 63 is cleaning the charging roller 62 or not because the charging roller 62 is rotated always following the rotation of the photosensitive body 60. In a case where the charging roller 62 is thus rotated by directly obtaining the driving force from the photosensitive body 60, the circumferential speed of the surface of the charging roller 62 is influenced by a speed (i.e., a process linear velocity corresponding to the circumferential speed of the surface of the photosensitive body 60) at which an image is formed. Therefore, in an image forming apparatus high in process linear velocity, the circumferential speed of the surface of a charging roller with which a cleaning member is kept in contact is increased. Accordingly, owing to heat generated by the rubbing of the cleaning member against the charging roller, a toner is liable to adhere to the photosensitive body or to the charging roller, or the surface of the charging roller might easily receive mechanical damage.

On the other hand, in a charging unit disclosed in Japanese Patent Application Early Laid-Open Publication Hei 5-188738, a belt is loose immediately after a charging roller is separated from a photosensitive body. In other words, the belt is not so tense as to transmit the driving force to the charging roller. For this reason, the rotation of the charging roller is once stopped, and then the belt is tensioned when the charging roller is separated from the photosensitive body by a predetermined distance, so that the rotation of the photosensitive body is transmitted to the charging roller. Therefore, the rotation of the charging roller starts a little late with respect to the timing of the separation of the charging roller from the photosensitive body. In addition, according to this arrangement, the belt also becomes loose when the charging roller is moved to come in contact with the photosensitive body and, therefore, the rotation of the charging roller is stopped immediately after the charging roller is separated from a cleaning member. Accordingly, the charging roller which is not being rotated is brought into contact with the photosensitive body which is rotating. This causes great abrasion of the cleaning member and damage to the photosensitive body. In addition, the driving duty of the charging member is greater than that in the case of kinetic friction.

SUMMARY OF THE INVENTION

The present invention was made to solve the above-mentioned problems. It is an object of the present invention to provide an image forming apparatus capable of reducing the adhesion of a toner to the photosensitive body and reducing mechanical damage to the surface of the charging member when the charging member is cleaned.

In order to achieve the object, the image forming apparatus according to the present invention is characterized in that the image forming apparatus includes a rotating photosensitive body, a charging member rotating in a direction opposite to a rotational direction of the photosensitive body while contacting the photosensitive body in order to uniformly charge a surface of the photosensitive body, a cleaning member for cleaning a surface of the charging member, and means for bringing the charging member into contact with the photosensitive body or separating the charging member from the photosensitive body. The charging member is rotated contacting the cleaning member in order to clean the charging member when the charging member is separated from the photosensitive body. The image forming apparatus further includes a speed reducing means for reducing a surface peripheral speed of the charging member made when the charging member is separated from the photosensitive body so as to become slower than a surface peripheral speed of the charging member maintained when the charging member is rotated contacting the photosensitive body. Preferably, the charging member is brought into contact with the photosensitive body or the cleaning member while being rotated. Further, preferably, the charging member is rotated in a direction opposite to a rotational direction of the photosensitive body, in other words, a rotational direction of the charging member taken when the charging member is in contact with the photosensitive body is the same as a rotational direction of the charging member taken when the charging member is in contact with the cleaning member. The speed reducing means has a rotating/driving source for rotating and driving the charging member when the charging member is separated from the photosensitive body, a rotation transmitting means for transmitting the rotation of the rotating/driving source to the charging member, and a one-way clutch for cutting off the transmission of the rotation of the rotating/driving source to the charging member through the rotation transmitting means when the charging member is in contact with the photosensitive body and for transmitting the rotation of the rotating/driving source to the charging member through the rotation transmitting means when the charging member is apart from the photosensitive body. Preferably, the rotating/driving source for the charging member is used for the photosensitive body. The rotation transmitting means may be a series of gears and may have belts and pulleys.

Further, in order to achieve the object, the image forming apparatus according to the present invention is characterized in that the image forming apparatus includes a rotating photosensitive body, a charging member which is rotated while contacting the photosensitive body in order to uniformly charge a surface of the photosensitive body, a cleaning member for cleaning a surface of the charging member, and a means for bringing the charging member into contact with the photosensitive body or separating the charging member from the photosensitive body. The charging member is rotated contacting the cleaning member in order to clean the charging member when the charging member is separated from the photosensitive body. The charging member is brought into contact with the photosensitive body while being rotated in a direction opposite to a rotational direction of the photosensitive body.

Further, in order to achieve the object, the image forming apparatus according to the present invention is characterized in that the image forming apparatus includes a rotating photosensitive body, a charging member which is rotated while contacting the photosensitive body in order to uniformly charge a surface of the photosensitive body, a cleaning member for cleaning a surface of the charging member, and a means for bringing the charging member into contact with the photosensitive body or separating the charging member from the photosensitive body. A rotational direction of the charging member taken when the charging member is in contact with the photosensitive body is the same as a rotational direction of the charging member taken when the charging member is in contact with the cleaning member. Preferably, the charging member is brought into contact with the cleaning member while being rotated.

DETAILED DESCRIPTION OF THE PREFERRED EMBODIMENTS

First Embodiment

Figure 1:
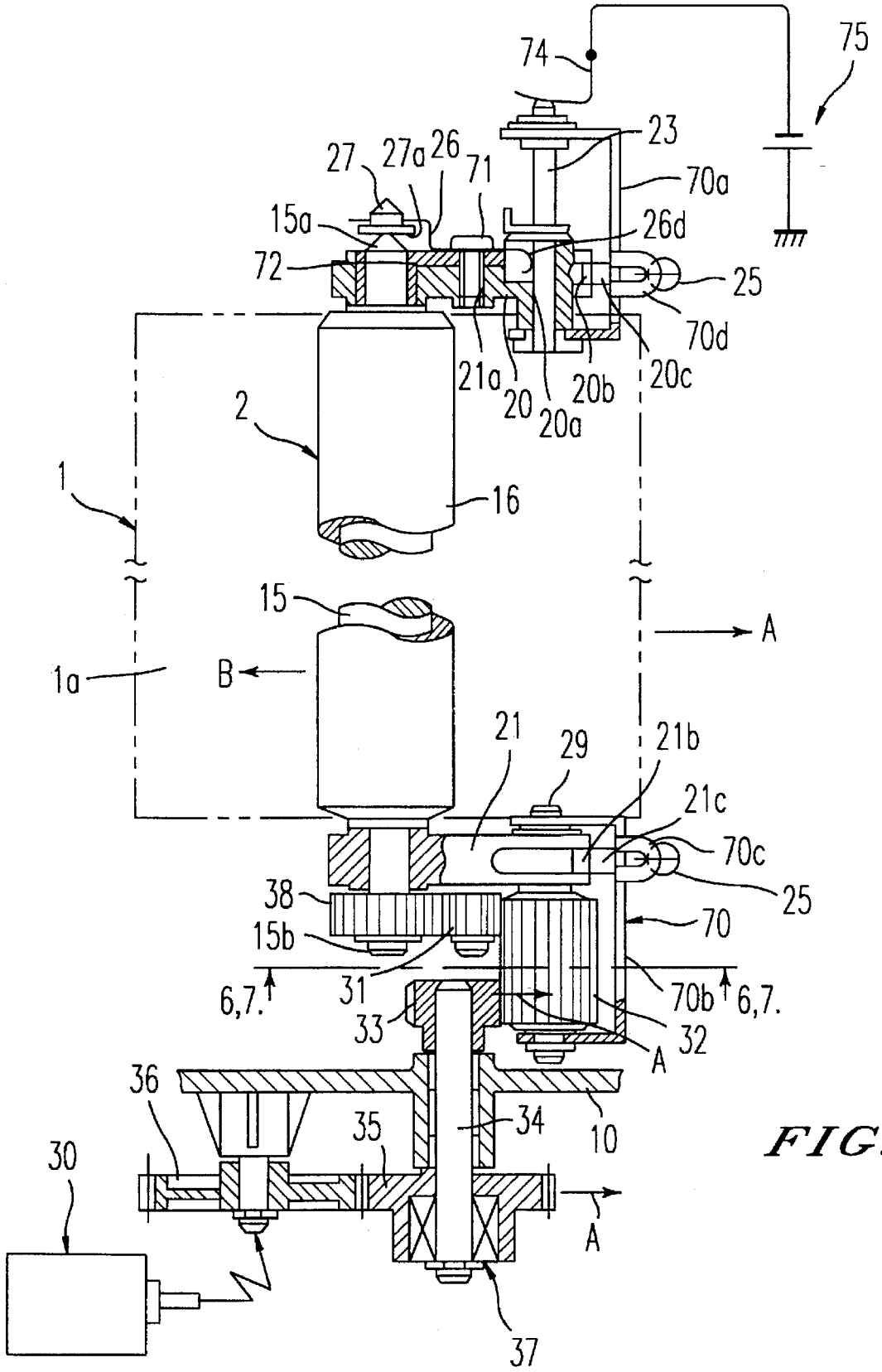
FIG. 1 is a plan view showing a charging roller and constituent parts relative to the charging roller of an electrophotographic type of image forming apparatus according to a first embodiment of the present invention.
Figure 2:
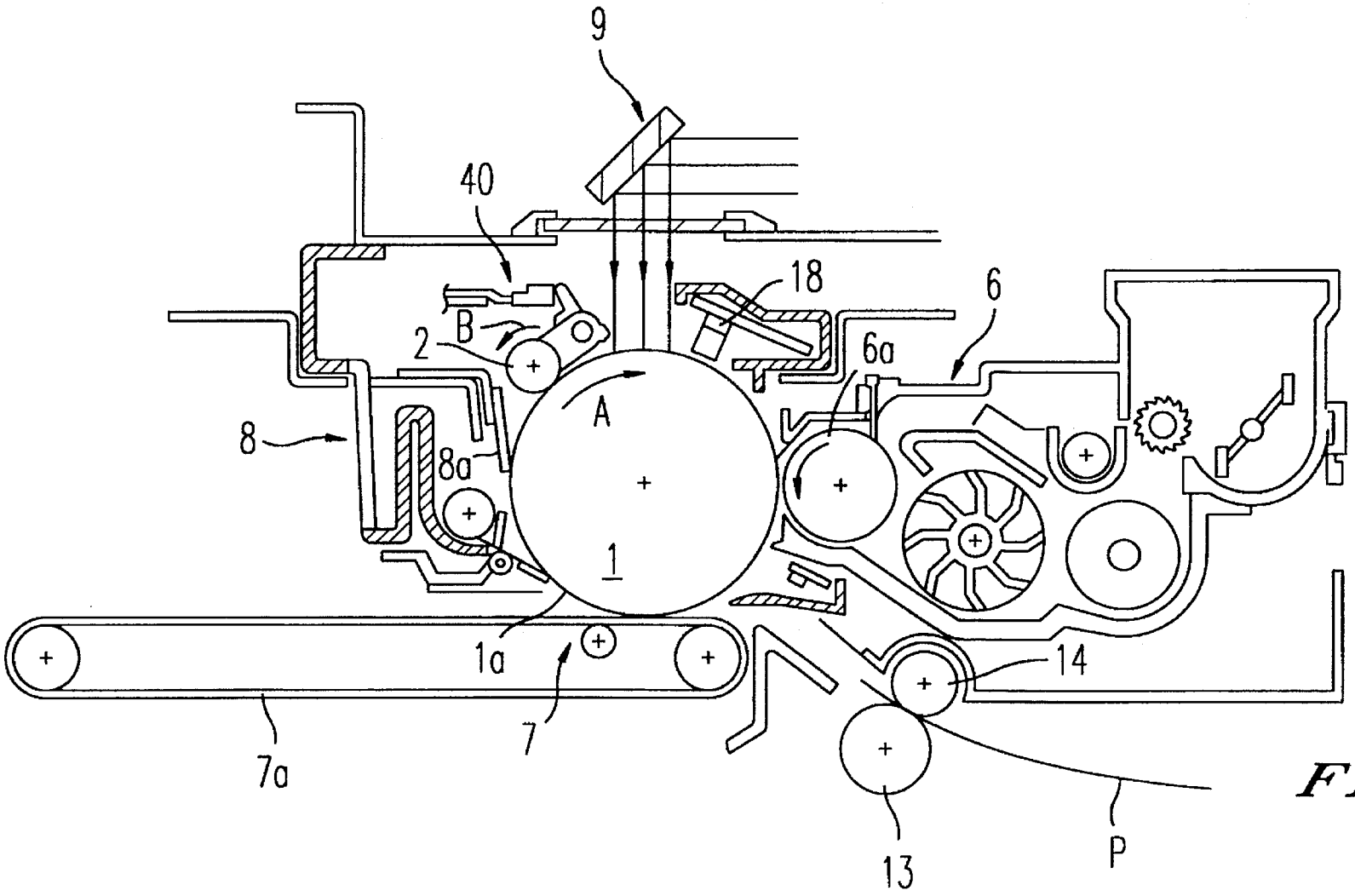
FIG. 2 is a front sectional view showing a diagrammatic construction of the image forming apparatus.

In FIGS. 1 and 2, reference numeral 1 designates a drum-like photosensitive body to be charged and reference numeral 2 designates a charging roller as a charging member. The charging roller 2 to which a given voltage is applied is brought into contact with the photosensitive body 1 when the photosensitive body 1 is charged. The contact pressure of the charging roller 2 against the photosensitive body 1 is approximately 10 g/cm (substantially linear contact). A detailed description of a contacting/separating mechanism 40 shown in FIG. 2 is omitted. When the charging roller 2 is brought into contact with the surface 1*a* of the photosensitive body 1, the surface la is evenly charged at a given electric potential. The photosensitive body 1 is rotated in the direction of arrow A shown in FIGS. 1 and 2 at a given surface-circumferential-speed (surface-peripheral-speed) whereas the charging roller 2 kept in contact with the photosensitive body 1 is rotated in the direction of arrow B at the same speed following the rotation of the photosensitive body 1.

The photosensitive body 1 is driven by a photosensitive body driving system which includes a drum-driving-timing-belt, a drum driving pulley, a motor 30 for driving the timing belt and pulley (see FIG. 1), and the like. As shown in FIG. 2, the charging roller 2, an eraser 18, a developing device 6, a contact type of transferring device 7 with a belt 7*a*, and a cleaning unit 8 are disposed around the photosensitive body 1.

The surface la of the photosensitive body 1 is illuminated with light emitted from an exposure device 9 (only a mirror portion of the device is shown in FIG. 2). The surface 1*a* uniformly charged by the charging roller 2 is exposed to the light and, as a result, an electrostatic latent image is formed on the surface 1*a*. The electrostatic latent image is trimmed by the eraser 18. The eraser 18 eliminates the electrostatic charge stored in an area of the surface 1*a* beyond the size of transfer paper P to be used. The remaining electrostatic latent image is developed by a toner fed from a developing sleeve 6*a* of a developing unit 6, so that a toner image (visible image) is formed. On the other hand, the transfer paper P in a paper feeding cassette (not shown) is sent out one by one from a paper feeding roller which rotates with a once given timing. In order to adjust carrier timing to a transferring unit 7, the transfer paper P sent out therefrom is stopped once between a resist roller 13 and a pressure roller 14 which rotates pressing the resist roller 13. After that, the paper P is carried to the transferring unit 7 with proper timing. A transfer bias is applied to the paper P by means of the transferring unit 7, so that a toner image is transferred to the top side of the paper P (see FIG. 2). The paper P is then separated from the photosensitive body 1 and is carried to a fixing device (not shown). After the toner on the paper P is fixed in the fixing device, the paper P is sent out to, for example, a paper receiving tray disposed outside the apparatus. After the completion of the transferring process, foreign objects, such as a paper powder or toner left on the photosensitive body 1, are removed by a cleaning blade 8*a* of the cleaning unit 8. An electric potential left on the photosensitive body 1 is removed by an electricity removing device (not shown). Thereby, the photosensitive body 1 makes preparations for the next charge by the charging roller 2.

The charging roller 2 comprises an electrically-conductive rubber roller portion 16 integrally attached to the outer side of an electrically-conductive core 15 made of iron or the like (see FIG. 1). Both ends of the core 15 are rotatably supported by bearings 20 and 21 made of resin, respectively.

The bearing 20 is adapted to support the electrically-conductive core 15 of the charging roller 2 at an end of the bearing 20. A hole 20*a* is formed in the other end of the bearing 20. A threaded hole 21*a* is formed in the middle of the bearing 20. An electrically-conductive support shaft 23 is turnably inserted in the hole 20*a*. Both ends of the support shaft 23 are supported by a feeder side support portion 70*a* of a bracket 70 bent into a ⊐-shape. The bearing 20 is capable of turning about the support shaft 23. The bracket 70 is made of a steel plate.

Figure 3:
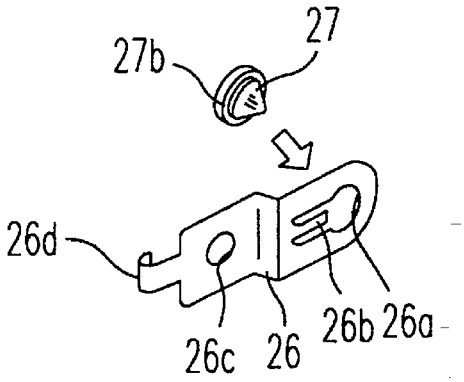
FIG. 3 is a perspective view showing an electrically-conductive feed plate and a feed terminal, which are adapted to apply a high voltage to the charging roller of FIG. 1.
Figure 4:
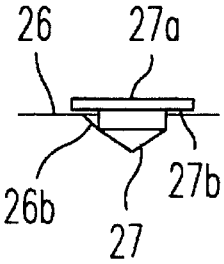
FIG. 4 is a plan view showing the electrically-conductive feed plate attached to the feed terminal.

The electrically-conductive core 15 of the charging roller 2 has a semi-spherical end portion 15*a* (see FIG. 1) which is in contact with a flat surface 27*a* of a feed terminal 27. The feed terminal 27 has a collar 27*b* as shown in FIGS. 3 and 4. This collar 27*b* is pushed into a hole 26*a* formed in an electrically-conductive plate 26 having spring properties. Thereby, the collar 27*b* is brought into contact with the surface of the plate 26 as shown in FIG. 4. The electrically-conductive plate 26 has a claw 26*b* by which the feed terminal 27 is prevented from falling off.

Also, the electrically-conductive plate 26 is provided with a mounting hole 26*c* as shown in FIG. 3. A screw 71 is inserted into the mounting hole 26*c* as shown in FIG. 1 and then is tightened and engaged with the threaded hole 21*a* of the bearing 20, so that the electrically-conductive plate 26 is firmly secured to the bearing An electrically-conductive member 72 is interposed between the electrically-conductive plate 26 and the bearing 20. An inner peripheral surface of a contact area extending up to the charging roller 2 of the electrically-conductive member 72 is in contact with an outer peripheral surface of the electrically-conductive core 15. A curled portion 26*d* at one end (see FIGS. 1 and 3) of the electrically-conductive plate 26 is in contact with an outer peripheral surface of the support shaft 23 under a predetermined contact pressure so that the curled portion 26d and the support shaft 23 are electrically connected to each other.

Also, a contactor 74 having spring properties is brought into contact with one end of the support shaft 23 and the contactor 74 is brought into contact with a high voltage power source 75. As a consequence, a high voltage from the power source 75 is applied to the electrically-conductive core 15 of the charging roller 2.

On the other hand, the bearing 21 rotatably supports the other end of the charging roller 2 and also rotatably supports the support shaft 29. Both ends of the support shaft 29 are supported by a driving-side-support-portion 70*b* of the bracket 70 bent into a reversed-C-shape (⊐-shape), so that the bearing 21 is rotated about the support shaft 29. The bearing 21 also rotatably supports an intermediate gear 31 and a gear 32 which is engaged with the intermediate gear 31. The intermediate gear 31 is engaged with a roller driving gear 38 which is secured to one end of the electrically-conductive core 15 of the charging roller 2.

A gear support shaft 34 is rotatably supported by a unit case (apparatus fastening portion) 10 shown in FIG. 1. The gear 32 is in engagement with a transmission gear 33 which is secured to one end of the gear support shaft 34, whereas a driving gear 35 is mounted on the other end of the gear support shaft 34 through a one-way clutch 37 included in the driving gear 35.

Figure 5:
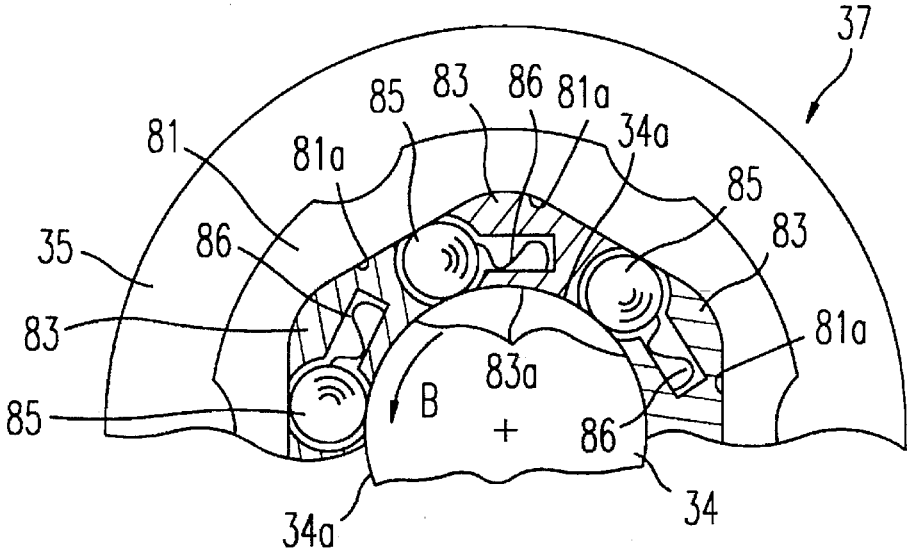
FIG. 5 is a diagrammatic view showing an internal construction of a one-way clutch assembly for transmitting a driving force to the charging roller.

Further, a driving force transmission gear 36, which is rotatably supported by the unit case 10, is engaged with the driving gear 35, and the driving force transmission gear 36 is rotated by means of a motor 30 which can also rotate the photosensitive drum 1. The one-way clutch 37 serves as a part of a speed reducing means for reducing the surface peripheral speed of the charging roller 2 which is in a position spaced away from the photosensitive drum 1 so as to become slower than that of the charging roller 2 which is in contact with the photosensitive drum 1 and rotated together with the drum 1. FIG. 5 is a schematic view showing an internal construction of the one-way clutch 37.

The one-way clutch 37 has a clutch housing 81 integrally secured to the driving gear 25. Linear portions 81*a* are formed on an inner peripheral surface of the clutch housing 81 at predetermined intervals. A plurality of wedge portions are formed by the linear portions 81*a* between the inner peripheral surface of the clutch housing 81 and an outer peripheral surface 34*a* of the gear support shaft 34. A plurality of spring retainer blocks 83 are inserted and secured between the clutch housing 81 and the gear support shaft 34. The spring retainer blocks 83 each have a shaft receiving surface 83*a*. The gear support shaft 34 is rotatably supported by the shaft receiving surfaces 83*a*. In FIG. 5, the wedge portion is formed narrower counterclockwise.

Needle rollers 85 are each rotatably inserted between the adjacent spring retainer blocks 83. The needle rollers 85 are arranged to rotate and move slightly in the peripheral direction therebetween. The spring retainer blocks 83 each have a spring retainer groove in which a spring 86 is fitted. The needle roller 85 is pressed by the action of the spring 86 in the direction of arrow B (see FIG. 5), namely, onto the narrow portion between the linear portion 81*a* and the outer peripheral surface 34*a*.

The rotational transmission of the one-way clutch 37 is carried out by the use of a difference in rotational speed between the driving gear 35 and the gear support shaft 34. In this embodiment, the gear ratio of the above-mentioned gears is set such that a surface peripheral speed V at the time when the charging roller 2 is spaced away from the photosensitive drum 1 becomes slower than a surface peripheral speed $V_\phi$ at the time when the charging roller 2 is rotated contacting the photosensitive drum 1.

Supposing that the charging roller 2 is in contact with the photosensitive drum 1 and rotated following the rotation of the photosensitive drum 1, when the photosensitive drum 1 is rotated in the direction of arrow A in FIG. 1, the charging roller 2 is rotated in the direction of arrow B, and then the rotation of the charging roller 2 is transmitted to a transmission sear 33 via the intermediate gears 31, 32. The rotational direction of the transmission gear 33 is the same as that of the photosensitive drum 1 (i.e., the direction of arrow A). The gear support shaft 34 and the transmission gear 33 are rotated in the same direction. On the other hand, the driving gear 35 receives the rotational force of the motor 30 via the driving force transmission gear 36 and thereby is rotated in the rotational direction of the photosensitive drum 1 (i.e., the direction of arrow A). When the roller 2 is in contact with the photosensitive drum 1 and rotated following the rotation of the photosensitive drum 1, the number of rotations of the gear support shaft 34 is larger than that of the driving gear 35 and therefore, the gear support shaft 34 is relatively rotated in a direction opposite to the direction of arrow B shown in FIG. 5. As a result, the needle rollers 85 are each rotated in the same direction against the action of the springs 86. For this reason, the needle roller 85 is moved to the broad part of the wedge portion, so that the one-way clutch 37 is unlocked. In other words, the clutch housing 81 and the gear support shaft 34 can be relatively rotated whereas the gear support shaft 34 is in a state of idling with respect to the driving gear 35. In brief, the roller driving gear 38, intermediate gears 31, 82, transmission gear 83, and gear support shaft 34 are all rotated by the driving force transmitted from the photosensitive drum 1 when the roller 2 is in contact with the photosensitive drum 1 and rotated following the rotation of the photosensitive drum 1.

Next, supposing that the charging roller 2 is changed from a state where the roller 2 is in contact with the photosensitive drum 1 to a state where the roller 2 is spaced away from the photosensitive drum 1. When changed thus, the rotational speed of the gear support shaft 34 in the direction of arrow A (see FIG. 1) is reduced. On the other hand, the rotational speed of the driving gear 35 becomes larger than that of the gear support shaft 34 and therefore, the gear support shaft 34 can be relatively rotated in the direction of arrow B (see FIG. 5) because the driving gear 35 is being rotated at a constant speed in the direction of arrow A. Accordingly, force is generated for moving the needle rollers 85, which are each in point-contact with the outer peripheral surface 34*a* of the gear support shaft 34, in the direction of arrow B (see FIG. 5). Thereby, the needle roller 85 is moved to the narrow part of the wedge portion and then is pushed forcefully onto the outer peripheral surface 34*a* of the gear support shaft 34 and the linear portion 81*a*. As a result, the one-way clutch 37 is locked. In other words, the clutch housing 81 and the gear support shaft 34 are locked via the needle rollers 85, and the driving gear 35 and the gear support shaft 34 are connected to each other. In addition, by the rotational force of the driving gear 35, the charging roller 2 is rotated in a direction opposite to the rotational direction of the photosensitive drum 1 and, at the same time, is separated from the photosensitive drum 1 and is brought into contact with a cleaning member which will be described below.

Preferably, the one-way clutch 37 is disposed within the roller driving gear 38 if there is a sufficient disposing space.

According to this arrangement, the drive loads of the photosensitive drum 1 can be reduced because the driving force is not transmitted to the intermediate gears 31, 32, transmission gear 33, and driving gear 35 when the charging roller 2 is rotated following the rotation of the photosensitive drum 1.

A description will now be given of a contacting/separating mechanism 40 for bringing the charging roller 2 into or out of contact with the photosensitive drum 1 with reference to FIGS. 6 to 12.

Figure 6:
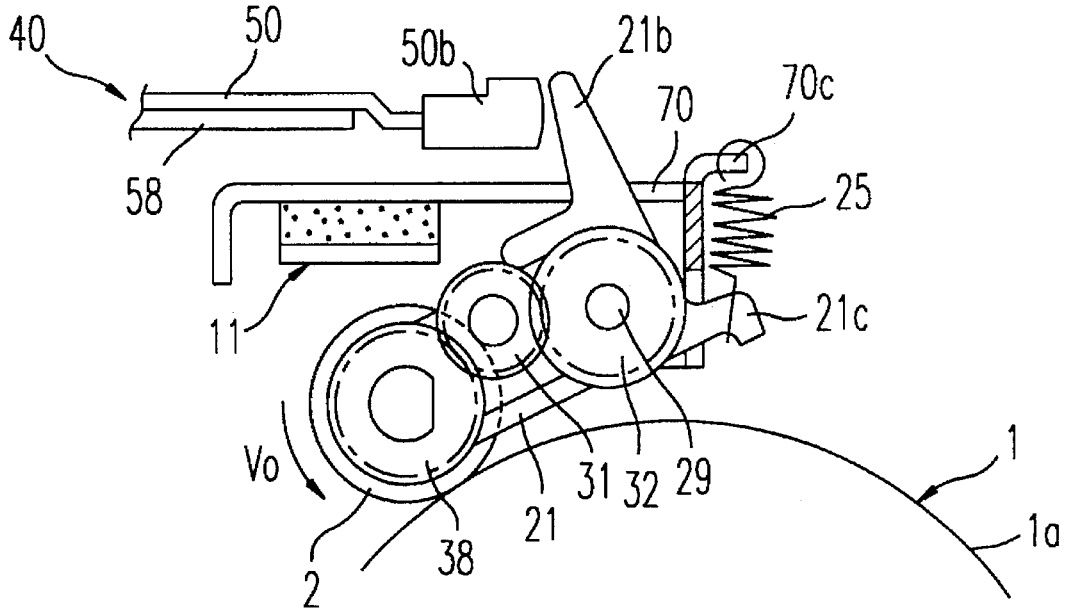
FIG. 6 is a sectional view taken along line 6—6 of FIG. 1, showing a state in which the charging roller is brought into contact with a photosensitive drum by a contacting/separating means mounted in the image forming apparatus of FIG. 2.

As shown in FIG. 6, the bearing 21 described with reference to FIG. 1 has a contact lever 21*b* jutting out of an upper surface of the bracket 70 on the upper side of the right-hand end of the bearing 21 and a hook 21*c* on the lower side thereof. A hook 70*c* as a pair to the hook 21*c* is also formed on the bracket 70. A tension spring 25 is laid between the hooks 21*c* and 70*c*. The bearing 21 receives force counterclockwise (see FIG. 6) about the support shaft 29 by the elasticity of the tension spring 25. Likewise, the bearing 20 shown in FIG. 1 also has a contact lever 20*b* jutting out of an upper surface of the bracket 70 on the upper side of the right-hand end of the bearing 20 and a hook 20*c* on the lower side thereof. A hook 70*d* as a pair to the hook 20*c* is also formed on the bracket 70. A tension spring 25 is laid between the hooks 20*c* and 70*d*. The bearing 20 also receives a force counterclockwise about the support shaft 23 due to the elasticity of the tension spring 25. The charging roller 2 is brought into contact with the surface 1*a* of the photosensitive drum 1 under a predetermined contact pressure by the elasticity of the tension springs 25, 25.

Figure 7:
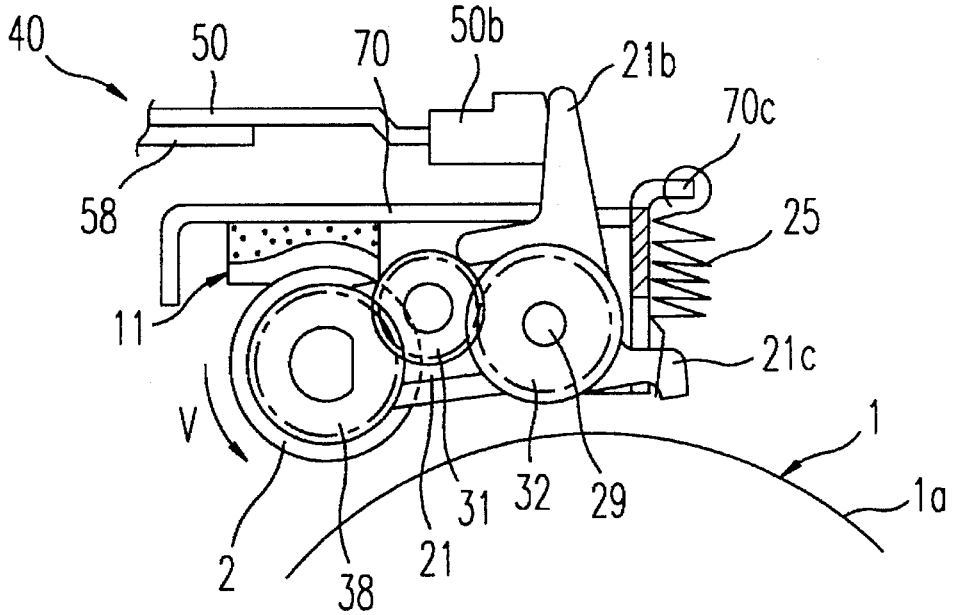
FIG. 7 is a sectional view taken along line 7—7 of FIG. 1, showing a state in which the charging roller is apart from the photosensitive drum.

The contacting/separating mechanism 40 has pressing cams 50*a* (see FIG. 9) and 5O*b*. When the image forming process is finished, the contact lever 20*b* of the bearing 20 and the contact lever 21*b* of the bearing 21 are simultaneously pressed by the pressing cams 50*a* and 50*b*, respectively. By this, the charging roller 2 is rotated clockwise (in FIG. 6) with respect to the support shaft 29 and then is separated from the surface la of the photosensitive drum 1 as shown in FIG. 7. A cleaning member 11 is secured to an inner surface of the bracket 70. The charging roller 2 is brought into contact with the cleaning member 11 in its separated position. When the charging roller 2 is separated from the photosensitive drum 1, the surface peripheral speed of the charging roller 2 is quickly changed by the action of the one-way clutch 37 and the gears to a surface peripheral speed V which is slower than a surface peripheral speed $V_\phi$ obtained when the charging roller 2 is rotated contacting the photosensitive drum 1.

In an image forming apparatus great in process linear speed, since the surface peripheral speed V of the charging roller 2 contacting the cleaning member 11 is increased, a toner is liable to adhere to the photosensitive drum 1 or to the charging roller 2 under the influence of heat generated by the rotational friction between the charging roller 2 and the cleaning member 11, or the surface of the charging roller 2 is liable to receive mechanical damage. However, according to the present invention, the above-mentioned disadvantages can be overcome because the charging roller 2 is rotated at a surface peripheral speed V which is slower than a surface peripheral speed $V_\phi$ maintained when the charging roller 2 is rotated contacting the photosensitive drum 1. In addition, according to this embodiment, the direction in which the charging roller 2 is rotated contacting the photosensitive drum 1 is the same as the direction in which the charging roller 2 is rotated contacting the cleaning member 11. Further, in a state in which the charging roller 2 is being rotated, the charging roller 2 is brought into contact with the cleaning member 11. Therefore, drive loads can be reduced.

Figure 8:
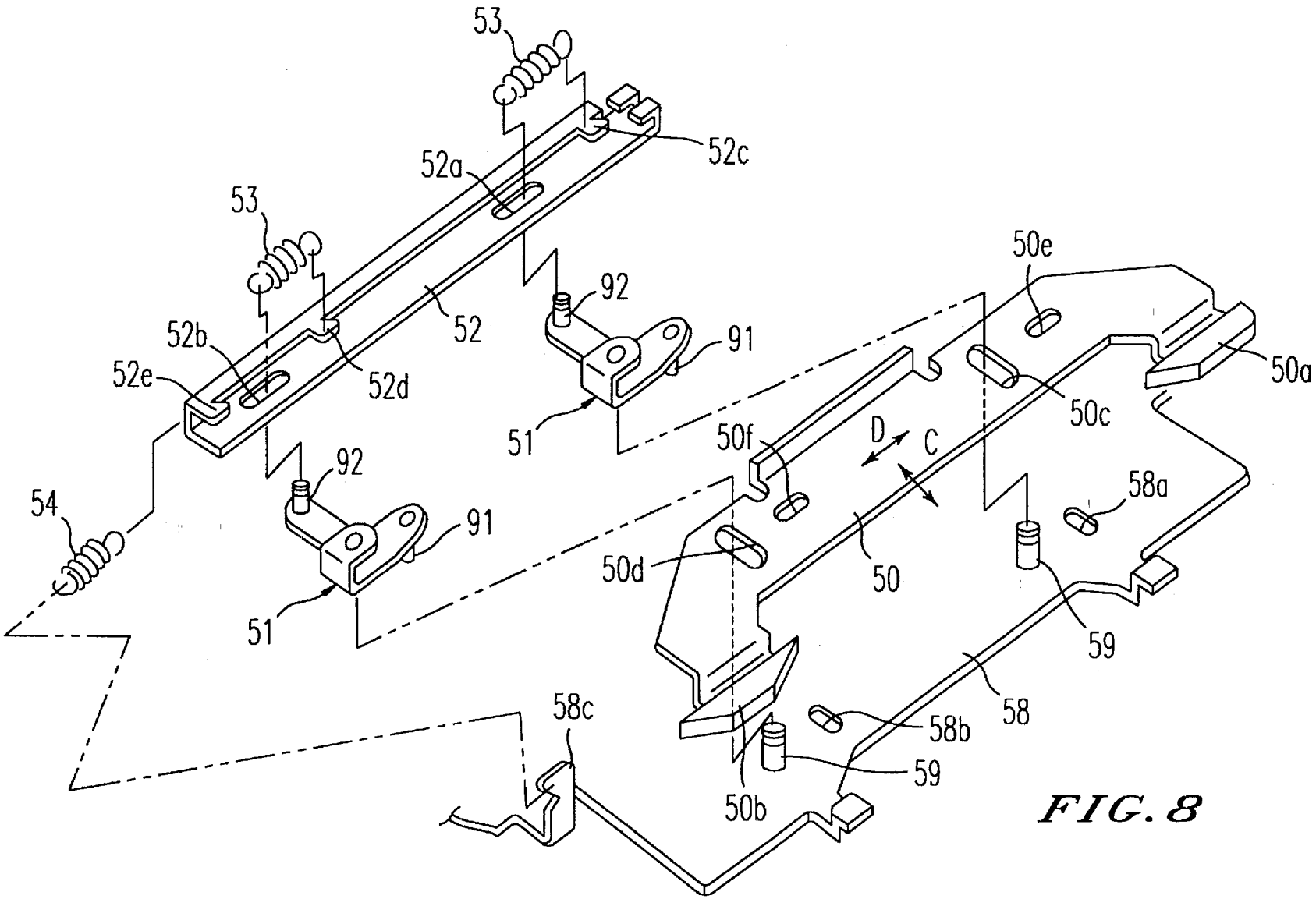
FIG. 8 is an exploded perspective view for explaining the contacting/separating means.

As shown in FIG. 8, the contacting/separating mechanism 40 includes a slide plate 50 for release, a link plate 52, and a holding bracket 58. The pressing cams 50*a* and 50*b* are formed integrally with the slide plate 50. The reason why these are thus formed is that timing with which the pressing cam 50*a* is brought into contact with the contact lever 20*b* (see FIG. 1) of the bearing 20 is caused to coincide with timing with which the pressing cam 50*b* is brought into contact with the contact lever 21*b* (see FIG. 1) of the bearing 21.

The slide plate 50 is reciprocated in the direction of arrow C and thereby the pressing cams 50*a* and 50*b* are brought into contact with or separated from the contact levers 20*b* and 21*b*, respectively. In the slide plate 50, elongate openings 50*c* and 50*d* are formed at a certain distance from each other. The elongate openings 50*c* and 50*d* are elongated in the direction of the reciprocation of the slide plate 50. Likewise, elongate openings 53*e* and 50*f* are formed at a certain distance from each other therein. The elongate openings 50*e* and 50*f* are elongated in the direction perpendicular to the reciprocative direction, namely, elongated in the direction of arrow D.

Pins 59, 59 erected straight on the holding bracket 58 are movably inserted in the elongate openings 50*c* and 50*d*, respectively, and L-shaped levers 51, 51 are turnably inserted in the pins 59, 59, respectively. The levers 51, 51 have pins 91, 91 projecting downward from one end thereof, respectively. The pins 91, 91 are inserted in the elongate openings 50*e* and 50*f* of the slide plate 50, and in elongate openings 58*a* and 58*b* formed in the holding bracket 58, respectively. Further, E-rings (not shown) are attached to heads of the pins 59, 59 so that the pins 59, 59 do not come off.

Also, as shown in FIG. 8, the levers 51, 51 have pins 92, 92 projecting upward from the other end thereof, respectively. The link plate 52 has elongate openings 52*a*, 52*b* for the pins 92, 92, respectively. The elongate openings 52*a*, 52*b* are elongated in the longitudinal direction. The link plate 52 also has hooks 52*c*, 52*d*, and 52*e* spaced away from each other. The pins 92, 92 are inserted in the elongate openings 52*a*, 52*b*, respectively. One end of each of tension springs 53, 53 is fastened to the top of each of the pins 92, 92. The other ends of the tension springs 53 are fastened to the hooks 52*c*, 52*d*, respectively.

Figure 9:
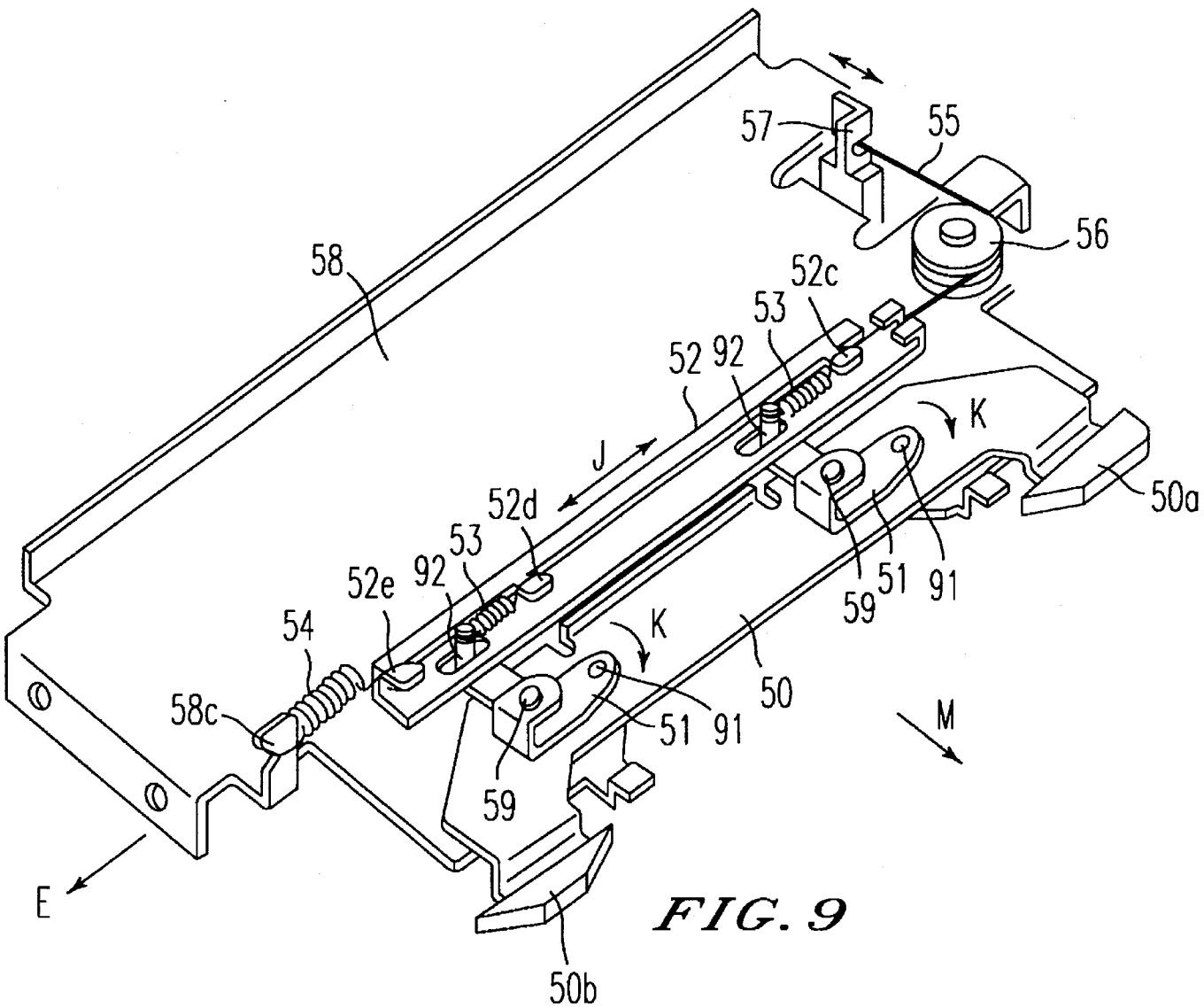
FIG. 9 is a perspective view showing how to attach the contacting/separating means of FIG. 8.

As shown in FIG. 9, one end of a tension spring 54 is fastened to the hook 52*e* of the link plate 52, and the other end of the tension spring 54 is fastened to a hook 58*c* of the holding bracket 58. By thus arranging them, the link plate 52 is pulled in the direction of arrow E in FIG. 9. One end of a driving wire 55 is secured to the other end of the link plate 52. The driving wire 55 is put on a pulley 56 which is rotatably supported by the holding bracket 58, so that the running direction of the driving wire 55 is changed by 90°. The other end of the driving wire 55 is fastened to a top of an oscillating lever 57 (see FIG. 10). The middle of the oscillating lever 57 is oscillatably supported by a shaft 93. The lower left-hand surface 57*a* of the oscillating lever 57 faces an eccentric cam 95.

The link plate 52 is pressed by the tension spring 54 in the direction of arrow E (see FIG. 9), and the driving wire 55 is pulled in the same direction (i.e., the direction of arrow E). Accordingly, the driving wire 55 is pulled in the direction of arrow F in FIG. 10 and accordingly the oscillating lever 57 is rotated in the direction of arrow G. As a result, the lower left-hand surface 57*a* of the oscillating lever 57 is always in contact with the eccentric cam 95.

Figure 10:
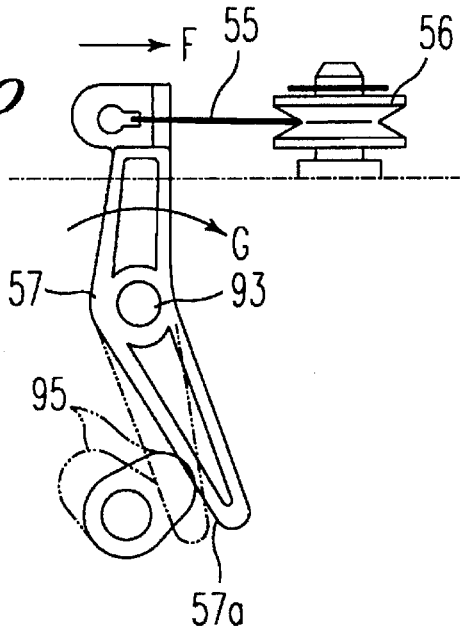
FIG. 10 is a diagrammatic view showing an eccentric cam for actuating the contacting/separating means.
Figure 11:
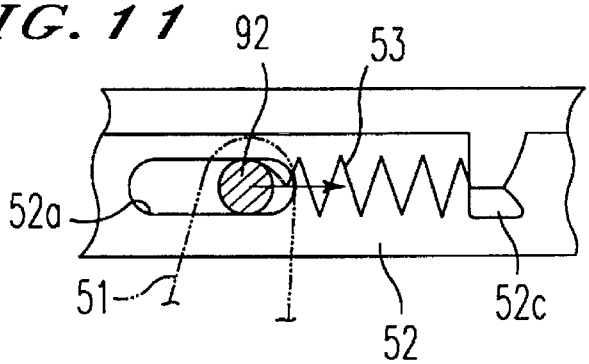
FIG. 11 is a plan view showing a positional relationship between a lever of the contacting/separating means and an elongate opening formed in a link plate, in a state in which the charging roller is apart from the photosensitive drum.

According to the contacting/separating mechanism 40, when the charging roller 2 is separated from the photosensitive drum 1, the eccentric cam 95 is turned from a position indicated by the phantom line to a position indicated by the continuous line in FIG. 10. Then, the oscillating lever 57 is turned in a direction opposite to the direction of arrow 6 and accordingly the driving wire 55 is pulled in a direction opposite to the direction of arrow F and, as a result, the link plate 52 shown in FIG. 9 is moved in the direction of arrow J. Accordingly, the pins 92, 92 of the levers 51, 51 are moved rightward in FIG. 11 and then the levers 51, 51 are turned in the direction of arrow K in FIG. 9. Since the pins 91, 91 of the levers 51, 51 are engaged with the elongate openings 50*e* and 50*f* (see FIG. 8) of the slide plate 50, respectively, the slide plate 50 is moved in the direction of arrow M in FIG. 9 under motion restrictions by the pins 91, 91. Accordingly, the pressing cam 50*b* (50*a*) is moved from a position shown in FIG. 6 to a position shown in FIG. 7, and the contact lever 21*b* of the bearing 21 and the contact lever 20*b* of the bearing 20 are simultaneously pressed by the pressing cams 50*b* and 50*a*, respectively, and as described above, the charging roller 2 is moved from the surface 1*a* of the photosensitive drum 1 to the spaced-away-position shown in FIG. 7. At that time, the charging roller 2 is brought into contact with the cleaning member 11 under predetermined pressure by the force of the tension spring 53 shown in FIG. 9.

Figure 12:
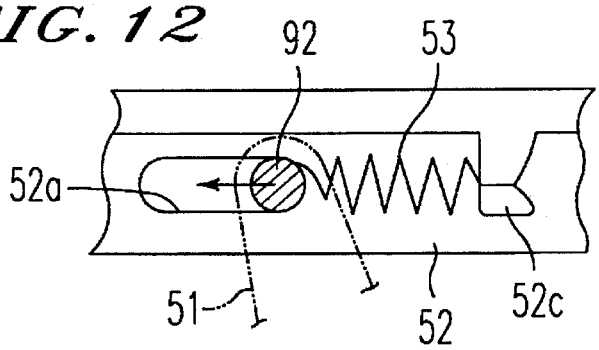
FIG. 12 is a plan view showing a positional relationship between the lever of the contacting/separating means and the elongate opening, in a state in which the charging roller is in contact with the photosensitive drum.

In order to bring the charging roller 2 into contact with the photosensitive drum 1, the eccentric cam 95 is turned to the position indicated by the phantom line in FIG. 10. Then, the oscillating lever 57 is turned in the direction of arrow G and the driving wire 55 is pulled back by the force of the tension spring 54. Accordingly, the link plate 52 is moved in the direction of arrow E. Consequently, as shown in FIG. 12, the pins 92, 92 of the levers 51, 51 are brought into contact with the end walls of the elongate openings 52*a* and 52*b* of the link plate 52 and thereby the pins 92, 92 are moved leftward in FIG. 12. Therefore, in FIG. 9, the levers 51, 51 are turned in a direction opposite to the direction of arrow K, and the slide plate 50 is moved in a direction opposite to the direction of arrow M. As a consequence, the pressing cams 5O*a* and 50*b* are separated from the contact levers 20*b* and 21*b*, respectively, and then the contact levers 20*b* and 21*b* are turned counterclockwise. Accordingly, the charging roller 2 is rotated and moved from the position apart from the photosensitive drum 1 shown in FIG. 7 to the contact position shown in FIG. 6, so that the charging roller 2 is brought into contact with the surface 1*a* of the photosensitive drum 1 again while the charging roller 2 is being rotated in a direction opposite to the rotational direction of the photosensitive drum 1. According to this arrangement, a difference in rotational speed between the charging roller 2 and the photosensitive drum 1 at the moment of their contact can be reduced and therefore mechanical damage or abrasion of the charging roller 2 and the photosensitive drum 1 can be avoided as much as possible. In addition, since the charging roller 2 is brought into contact with the cleaning member 11 while being rotated, kinetic frictional force acts on them, and therefore drive loads can be reduced in comparison with a case of static frictional force.

Second Embodiment

Figure 13:
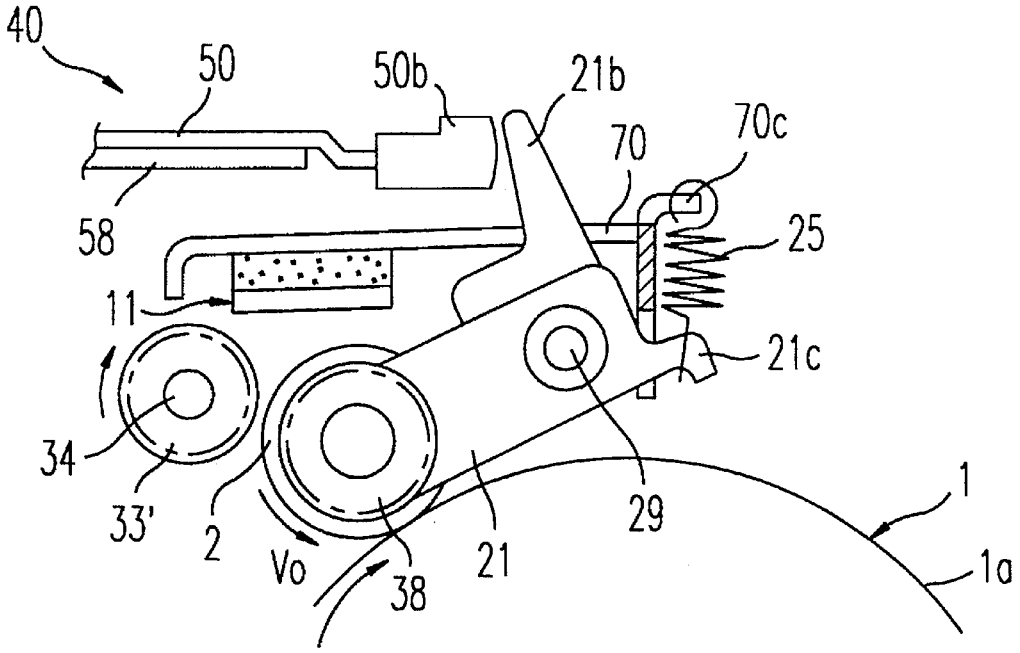
FIG. 13 is a view corresponding to FIG. 6, according to a second embodiment of the present invention.
Figure 14:
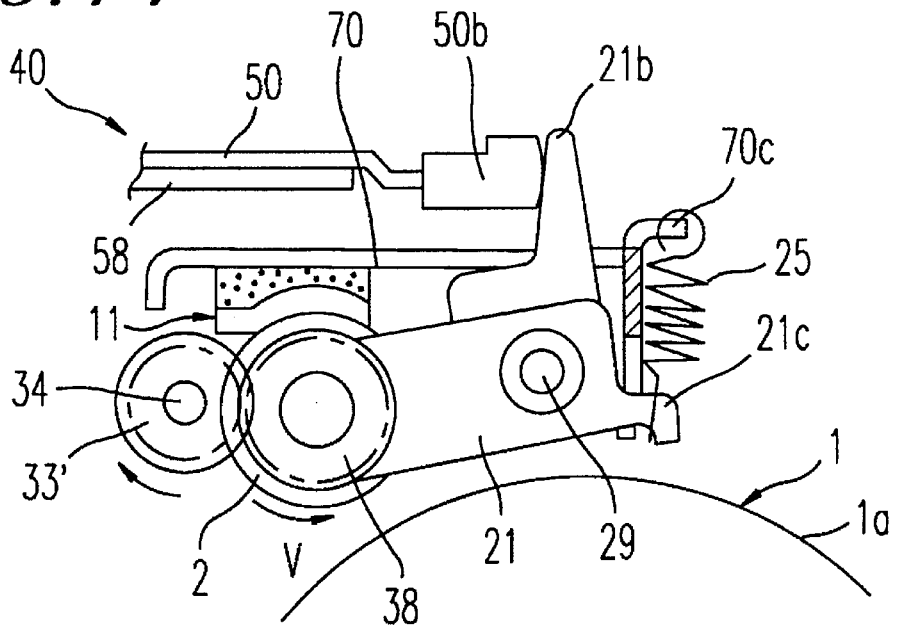
FIG. 14 is a view corresponding to FIG. 7, according to the second embodiment of the present invention.

FIGS. 13 and 14 are schematic views, like FIGS. 6 and 7, showing a second embodiment of the present invention. In FIGS. 13 and 14, the same numerals are given to constituents corresponding to those in FIGS. 6 and 7, respectively.

The second embodiment is different from the first embodiment in as mentioned the following discussion.

In the second embodiment, only a roller driving gear 38 is rotatably mounted on a bearing 21. The intermediate gears 31 and 32 are not mounted thereon. Instead, a transmission gear 33' is mounted on the unit case (apparatus fastening portion) 10 (see FIG. 1). The transmission gear 33' is arranged to be engaged with the roller driving gear 38 when the charging roller 2 (see FIG. 14) is moved to the position spaced away from the photosensitive drum 1. The transmission gear 33' is the equivalent of the transmission gear 33, and a difference between them is only the place to be disposed. The transmission gear 33' is secured to one end of the gear support shaft 34, and the driving gear 35 shown in FIG. 1 is secured to the other end thereof via the one-way clutch 37. As shown in FIG. 14, when the transmission gear 33' is in engagement with the roller driving gear 38, the charging roller 2 is, as in the first embodiment, rotated at a surface peripheral speed V slower than a surface peripheral speed $V_\phi$ maintained when the charging roller 2 is rotated contacting the photosensitive drum 1. According to the second embodiment, immediately before the roller driving gear 38 is brought into contact with the transmission gear 33' after the charging roller 2 is separated from the photosensitive drum 1, and immediately before the charging roller 2 is brought into contact with the photosensitive drum 1 after the charging roller 2 is separated from the cleaning member 11, the charging roller 2 almost stops its rotation. This is different from that in the first embodiment, but does not cause any problems.

A description will now be given of an optimum surface peripheral speed of the charging roller 2 made when the charging roller 2 is cleaned.

The optimum surface peripheral speed Vc of the charging roller 2 at the cleaning time is represented as follows:

$$Vc=\pi \cdot d \cdot Nt/\Sigma T$$

where Nt is the number of rotations of the charging roller 2 up to which the surface of the charging roller 2 can mechanically stand long use against rotational friction, d is the outer diameter of the charging roller 2, and ΣT is the total of time for cleaning the charging roller 2.

Accordingly, by setting the surface peripheral speed V of the charging roller 2 maintained when the charging roller 2 is cleaned approximately at or close to the above-mentioned optimum surface peripheral speed Vc, stable roller cleaning efficiency can be maintained for a long time without destroying the durability of the charging roller 2.

In the first and second embodiments, both the photosensitive drum 1 and the charging roller 2 are rotated by the single motor Instead, they may be rotated by respective motors.

As described above, according to the first and second embodiments, even in an image forming apparatus high in process linear speed, the surface peripheral speed of the charging member can be made slower than a speed maintained when the charging member is rotated contacting the photosensitive drum. Therefore, a toner is prevented from adhering to the surface of the charging member because of heat generated when the charging member is rotated contacting the cleaning member, or the surface of the charging member is prevented from receiving mechanical damage and therefore the charging member can be effectively cleaned up.

Third Embodiment

Figure 15:
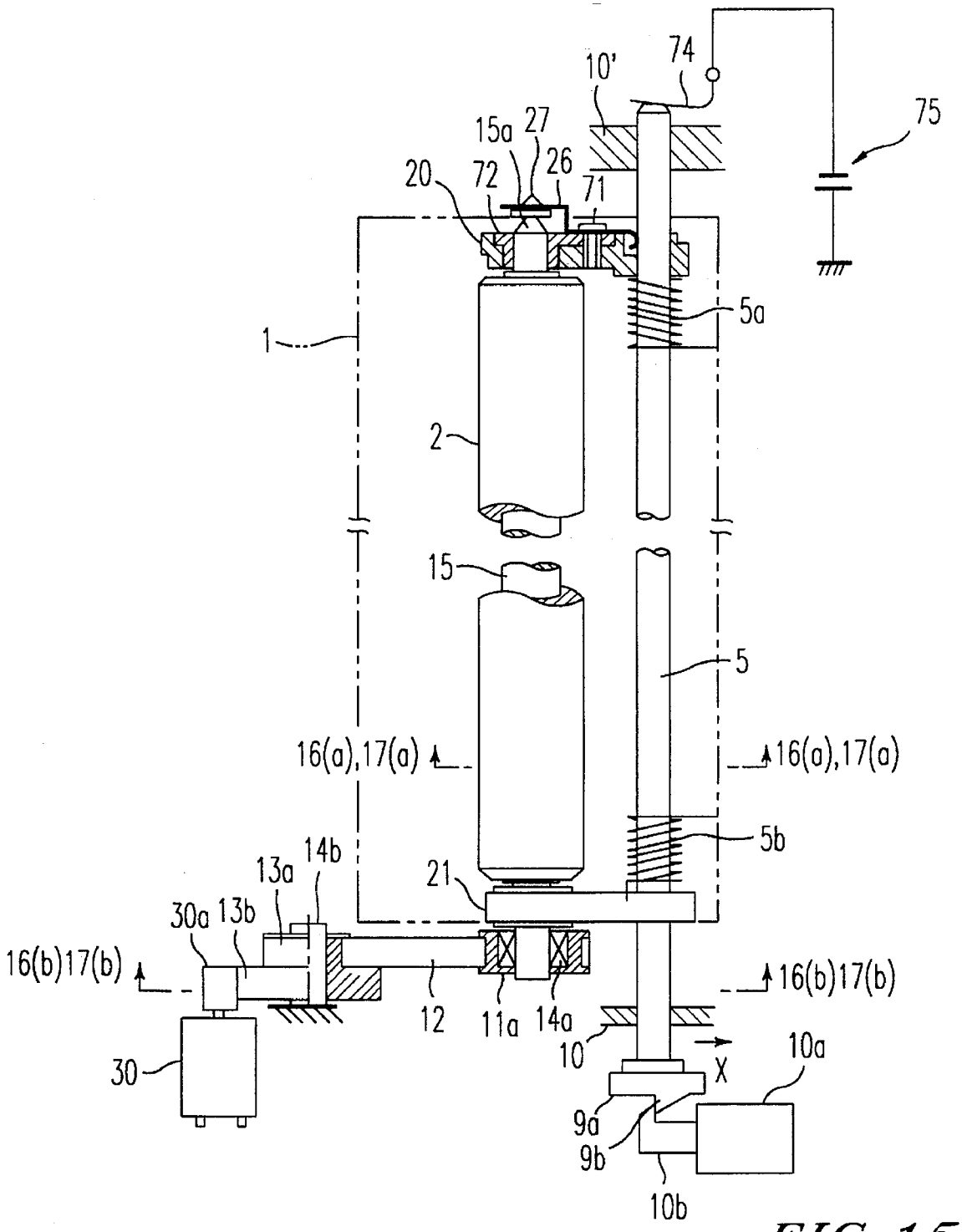
FIG. 15 is a plan view showing a charging roller and constituent parts relative to the charging roller of an electrophotographic type of image forming apparatus according to a third embodiment of the present invention.
Figure 16B:
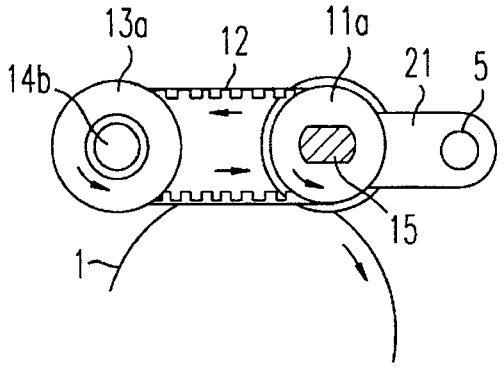
FIG. 16(*a*) is a sectional view taken along line 16*a*—16*a* of FIG. 15, showing a state in which a photosensitive drum is in contact with a charging roller, and FIG. 16(*b*) is a sectional view taken along line 16*b*—16*b* of FIG. 15, for explaining rotational transmission from the photosensitive drum to a pulley mounted on the side of a rotating/driving source via a belt.
Figure 16A:
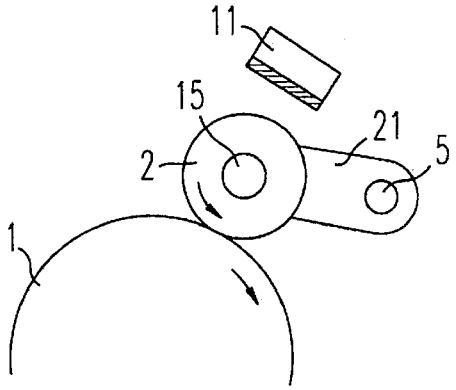
Figure 17B:
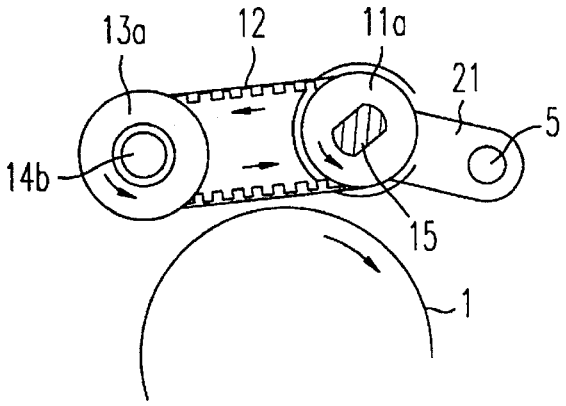
FIG. 17(*a*) is a sectional view taken along line 17*a*—17*a* of FIG. 15, showing a state in which the charging roller is apart from the photosensitive drum, and FIG. 17(*b*) is a sectional view taken along line 17*b*—17*b* of FIG. 15, for explaining rotational transmission from the pulley to the charging roller via the belt.
Figure 17A:
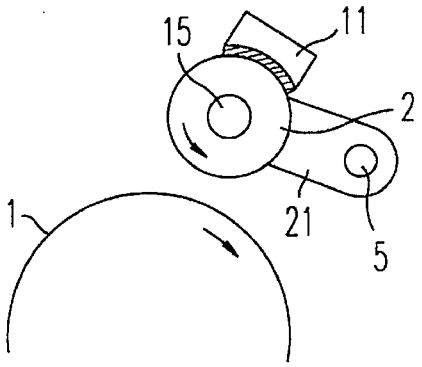
Figure 18:
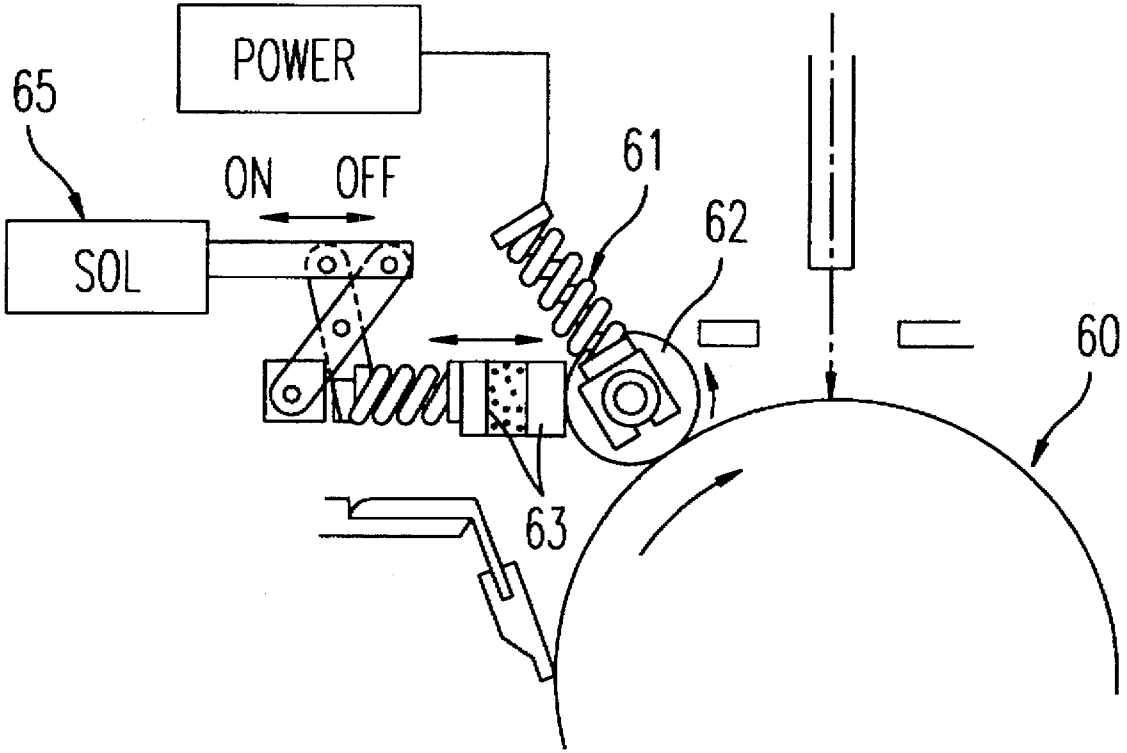
FIG. 18 PRIOR ART
FIG. 18 is a schematic view showing an example of a conventional contact-and-charge type of charging unit.

In a third embodiment of the present invention, an arrangement is adopted in which a belt and a pulley each as a rotational transmission mechanism are used instead of a gear. Referring to FIG. 15, a roller support shaft 5 is laid between apparatus fixing portions 10 and 10'. A base of one end of a bearing 20 which is placed on the power supplying side is fastened to the roller support shaft 5 and, likewise, a base of one end of a bearing 21 which is placed on the driving side is fastened thereto. A lever 9*a* for releasing a charging roller 2 is fastened to an end of the roller support shaft 5 on the driving side. The lever 9*a* has an engagement projection 9*b* with which the tip of a rod 10*b* of a solenoid 10*a* is engaged. Torsion coil springs 5*a* and 5*b* are wound around the roller support shaft 5. An end of each of the torsion coil springs 5*a* and 5*b* is fastened to an apparatus fixing portion (not shown), and the other end thereof is fastened to each of the bases of the bearings 20 and 21. The torsion coil springs 5*a* and 5*b* serve to rotate and move the roller support shaft 5 in a direction in which the charging roller 2 is brought into contact with the photosensitive drum 1. The lever 9*a* is rotated about the roller support shaft 5. In FIG. 15, when the rod lob is moved in the direction of arrow X, the roller support shaft 5 is rotated in a direction in which the charging roller 2 is separated from the photosensitive drum 1. On the other hand, when the rod 10*b* is moved in a direction opposite to the direction of arrow X, the roller support shaft 5 is rotated in a direction in which the charging roller 2 is brought into contact with the photosensitive drum 1. A pulley 11*a* is fastened to an end of the charging roller 2 on the driving side through a one-way clutch 14*a*. A motor 30 is provided with an output gear 30*a* with which a driving gear 13*b* is engaged. The driving gear 13*b* is rotatably supported by a shaft 14*b*. The shaft 14*b* is supported by the apparatus fixing portion (not shown). A pulley 13*a* is fastened to the shaft 14*b*. A belt 12 is stretched between the pulleys 13*a* and 11*a*. The one-way clutch 14*a* serves to communicate the rotation of the driving gear 13*b* to the pulley 13*a* and, at the same time, cut off the communication of the rotation of the pulley 13*a* to the driving Sear 13*b*. As shown in FIG. 16(*a*), when the charging roller 2 is in contact with the photosensitive drum 1, the motor 30 does not need to be stopped because of the one-way clutch 14*a*. Since the communication of the rotation of the charging roller 2 to the driving gear 13*b* is cut off by the one-way clutch 14*a*, the pulley 11*a* runs idly. Next, when the rod 10*b* of the solenoid 10*a* is rotated in the direction of arrow X in FIG. 15, the bearing 21 is rotated about the roller support shaft 5 in a direction in which the charging roller 2 is separated from the photosensitive drum 1, so that the charging roller 2 is brought into contact with the cleaning member 11. The rotation of the output gear 30*a* is communicated to the one-way clutch 14*a* through the driving gear 13*b*, the pulley 13*a*, the belt 12, and the pulley 11*a* each shown in FIG. 17(*b*). The charging roller 2 is rotated at a surface peripheral speed V which is slower than a surface peripheral speed $V_\phi$ maintained when the charging roller 2 is rotated contacting the photosensitive drum 1.

What is claimed is:

1. An image forming apparatus comprising:

a rotating photosensitive body;

a charging member rotating in a direction opposite to a rotational direction of said photosensitive body while contacting said photosensitive body and uniformly charging a surface of said photosensitive body;

a cleaning member cleaning a surface of said charging member;

means for bringing said charging member into contact with said photosensitive body or separating said charging member from said photosensitive body;

said charging member being rotated while contacting said cleaning member and cleaning said charging member when said charging member is separated from said photosensitive body; and speed reducing means for reducing a peripheral surface speed of said charging member when said charging member is separated from said photosensitive body so as to become slower than a peripheral surface speed of said charging member maintained when said charging member is rotated contacting said photosensitive body.

2. An image forming apparatus according to claim 1, wherein said charging member is brought into contact with said photosensitive body while being rotated in a direction opposite to a rotational direction of said photosensitive body.

3. An image forming apparatus according to claim 2, wherein a rotational direction of said charging member taken when said charging member is in contact with said photosensitive body is the same as a rotational direction of said charging member taken when said charging member is in contact with said cleaning member.

4. In image forming apparatus according to claim 1, wherein said charging member is brought into contact with said cleaning member while rotating.

5. An image forming apparatus according to claim 1 wherein said speed reducing means comprises:

a rotating/driving source for rotating and driving said charging member when said charging member is separated from said photosensitive body;

rotation transmitting means for transmitting rotation of said rotating/driving source to said charging member; and a one-way clutch cutting off the transmission of the rotation of said rotating/driving source to said charging member through said rotation transmitting means when said charging member is in contact with said photosensitive body and transmitting the rotation of said rotating/driving source to said charging member through said rotation transmitting means when said charging member is apart from said photosensitive body.

6. In image forming apparatus according to claim 5, wherein a rotating/driving source for said photosensitive body is used as a rotating/driving source for said charging member.

7. An image forming apparatus according to claim 5, wherein said rotation transmitting means comprises a series of gears.

8. An image forming apparatus according to claim 5, wherein said rotation transmitting means includes belts and pulleys.

9. An image forming apparatus according to claim 1, wherein said charging member is brought into contact with said cleaning member while rotating, and a rotational direction of said charging member taken when said charging member is in contact with said photosensitive body is the same as a rotational direction of said charging member taken when said charging member is in contact with said cleaning member.

10. An image forming apparatus according to claim 9, wherein said speed reducing means comprises:

a rotating/driving source rotating and driving said charging member when said charging member is separated from said photosensitive body;

rotation transmitting means for transmitting rotation of said rotating/driving source to said charging member; and a one-way clutch cutting off the transmission of rotation of said rotating/driving source to said charging member through said rotation transmitting means when said charging member is in contact with said photosensitive body and transmitting rotation of said rotating/driving source to said charging member through said rotation transmitting means when said charging member is apart from said photosensitive body.

11. An image forming apparatus according to claim 10, wherein a rotating/driving source for said photosensitive body is used as a rotating/driving source for said charging member.

12. An image forming apparatus according to claim 10, wherein said rotation transmitting means comprises a series of gears.

13. An image forming apparatus according to claim 10, wherein said rotation transmitting means includes belts and pulleys.

14. An image forming apparatus, comprising:

a rotating photosensitive body;

a charging member rotating while contacting said photosensitive body and uniformly charging a surface of said photosensitive body;

a cleaning member cleaning a surface of said charging member; and means for bringing said charging member into contact with said photosensitive body or separating said charging member from said photosensitive body;

said charging member being rotated while contacting said cleaning member and cleaning said charging member when said charging member is separated from said photosensitive body;

wherein said charging member is rotated in a direction opposite to a rotational direction of said photosensitive body and is brought into contact with said photosensitive body.

15. An image forming apparatus comprising:

a rotating photosensitive body;

a charging member rotating while contacting said photosensitive body and uniformly charging a surface of said photosensitive body;

a cleaning member cleaning a surface of said charging member; and means for bringing said charging member into contact with said photosensitive body or separating said charging member from said photosensitive body;

said charging member being rotated while contacting said cleaning member and cleaning said charging member when said charging member is separated from said photosensitive body;

wherein a rotational direction of said charging member taken when said charging member is in contact with said photosensitive body is the same as a rotational direction of said charging member taken when said charging member is in contact with said cleaning member.

16. An image forming apparatus according to claim 14 or 15 wherein said charging member is brought into contact with said cleaning member while rotating.

17. An image forming apparatus, comprising:

a rotating photosensitive body;

a charging member rotating in a direction opposite to a rotational direction of said photosensitive body while contacting said photosensitive body in order to uniformly charge a surface of said photosensitive body;

a cleaning member cleaning a surface of said charging member; and a device bringing said charging member into contact with said photosensitive body or separating said charging member from said photosensitive body;

said charging member being rotated while contacting said cleaning member in order to clean said charging member when said charging member is separated from said photosensitive body; and a speed reducer reducing a peripheral surface speed of said charging member when said charging member is separated from said photosensitive body so as to become slower than a peripheral surface speed of said charging member maintained when said charging member is rotated contacting said photosensitive body.

18. An image forming apparatus according to claim 17, wherein said charging member is brought into contact with said photosensitive body while being rotated in a direction opposite to a rotational direction of said photosensitive body.

19. An image forming apparatus according to claim 18, wherein a rotational direction of said charging member taken when said charging member is in contact with said photosensitive body is the same as a rotational direction of said charging member taken when said charging member is in contact with said cleaning member.

20. An image forming apparatus according to claim 17, wherein said charging member is brought into contact with said cleaning member while rotating.

21. An image forming apparatus according to claims 17, wherein said speed reducer comprises:

a source rotating and driving said charging member when said charging member is separated from said photosensitive body;

a rotation transmitter transmitting rotation of said rotating/driving source to said charging member; and a one-way clutch cutting off the transmission of the rotation of said rotating/driving source to said charging member through said rotation transmitter when said charging member is in contact with said photosensitive body and transmitting the rotation of said rotating/driving source to said charging member through said rotation transmitter when said charging member is apart from said photosensitive body.

22. An image forming apparatus according to claim 21, wherein a rotating/driving source for said photosensitive body is used as a rotating/driving source for said charging member.

23. An image forming apparatus according to claim 21, wherein said rotation transmitter comprises a series of gears.

24. An image forming apparatus according to claim 21, wherein said rotation transmitter includes belts and pulleys.

25. An image forming apparatus according to claim 17, wherein said charging member is brought into contact with said cleaning member while rotating, and a rotational direction of said charging member taken when said charging member is in contact with said photosensitive body is the same as a rotational direction of said charging member taken when said charging member is in contact with said cleaning member.

26. An image forming apparatus according to claim 25, wherein said speed reducer comprises:

a rotating/driving source rotating and driving said charging member when said charging member is separated from said photosensitive body;

a rotation transmitter transmitting rotation of said rotating/driving source to said charging member; and a one-way clutch cutting off the transmission of rotation of said rotating/driving source to said charging member through said rotation transmitter when said charging member is in contact with said photosensitive body and transmitting rotation of said rotating/driving source to said charging member through said rotation transmitter when said charging member is apart from said photosensitive body.

27. An image forming apparatus according to claim 26, wherein a rotating/driving source for said photosensitive body is used as a rotating/driving source for said charging member.

28. An image forming apparatus according to claim 26, wherein said rotation transmitter comprises a series of gears.

29. An image forming apparatus according to claim 26, wherein said rotation transmitter includes belts and pulleys.

30. An image forming apparatus, comprising:

a rotating photosensitive body;

a charging member rotating while contacting said photosensitive body and uniformly charging a surface of said photosensitive body;

a cleaning member cleaning a surface of said charging member; and a mechanism bringing said charging member into contact with said photosensitive body or separating said charging member from said photosensitive body;

said charging member being rotated while contacting said cleaning member and cleaning said charging member when said charging member is separated from said photosensitive body;

wherein said charging member is rotated in a direction opposite to a rotational direction of said photosensitive body and is brought into contact with said photosensitive body.

31. An image forming apparatus, comprising:

a rotating photosensitive body;

a charging member rotating while contacting said photosensitive body and uniformly charging a surface of said photosensitive body;

a cleaning member cleaning a surface of said charging member; and a mechanism bringing said charging member into contact with said photosensitive body or separating said charging member from said photosensitive body;

said charging member being rotated while contacting said cleaning member and cleaning said charging member when said charging member is separated from said photosensitive body;

wherein a rotational direction of said charging member taken when said charging member is in contact with said photosensitive body is the same as a rotational direction of said charging member taken when said charging member is in contact with said cleaning member.

32. An image forming apparatus according to claims 30 or 31, wherein said charging member is brought into contact with said cleaning member while rotating.

* * * * *